United States Patent [19]

Oakley et al.

[11] Patent Number: 4,843,380

[45] Date of Patent: Jun. 27, 1989

[54] ANTI-ALIASING RASTER SCAN DISPLAY SYSTEM

[75] Inventors: David Oakley; Donald I. Parsons, both of San Diego, Calif.

[73] Assignee: Megatek Corporation, San Diego, Calif.

[21] Appl. No.: 72,757

[22] Filed: Jul. 13, 1987

[51] Int. Cl.[4] ..... G09G 1/06

[52] U.S. Cl. ..... 340/723; 340/728

[58] Field of Search ..... 340/703, 723, 724, 728, 340/727, 731, 747; 382/49

[56] References Cited

U.S. PATENT DOCUMENTS

| | | | |
|---|---|---|---|
| 4,447,809 | 5/1984 | Kodama et al. | 340/747 |
| 4,484,188 | 11/1984 | Ott | 340/723 |
| 4,591,844 | 5/1986 | Hickin et al. | 340/728 |
| 4,656,467 | 4/1987 | Strolle | 340/727 |
| 4,672,369 | 6/1987 | Preiss et al. | 340/723 |
| 4,674,125 | 6/1987 | Carlson et al. | 382/49 |
| 4,677,576 | 6/1987 | Berlin Jr. et al. | 340/723 |
| 4,679,039 | 7/1987 | Neil et al. | 340/723 |
| 4,679,040 | 7/1987 | Yan | 340/703 |
| 4,694,407 | 9/1987 | Ogden | 340/747 |
| 4,698,768 | 10/1987 | Thuy et al. | 340/727 |
| 4,704,605 | 11/1987 | Edelson | 340/703 |

*Primary Examiner*—Gerald L. Brigance

*Assistant Examiner*—Richard Hjerpe

*Attorney, Agent, or Firm*—Charmasson & Holz

[57] ABSTRACT

A raster scan display system for eliminating jagged edges from vectors or polygon boundaries inclined within ±45 degrees to horizontal comprising a digital vector generator, a frame buffer memory, a color look-up table, digital-to-analog converters and convolvers placed in front of each digital-to-analog converter for each video output stage of the color look-up table. Fractional address data are appended to each pixel written into the frame-buffer memory to specify the true location of the pixel more accurately. Intensity data for each of the colors assigned thereto by the color look-up table are convolved with a kernel that is selected by the Y fractional address. The convolvers also process the X fractional address which controls the boundaries between pixels on a scan line. Fractional address data read out of the frame-buffer controls the kernels in the convolvers to render the positioning of pixels at four times the addressability of the frame-buffer. Each pixel is micropositioned to an accuracy that is approximately one quarter of the CRT spot diameter. The convolvers double the number of displayed lines, allow for a very rapid rendition of the displayed image, and operate at the troughput of the graphics display system. Memory size is also reduced and image quality greatly enhanced.

3 Claims, 10 Drawing Sheets

PRIOR ART
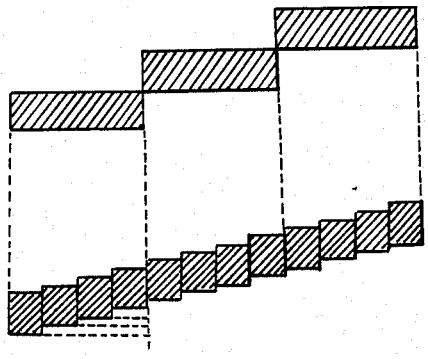
FIG. 1B
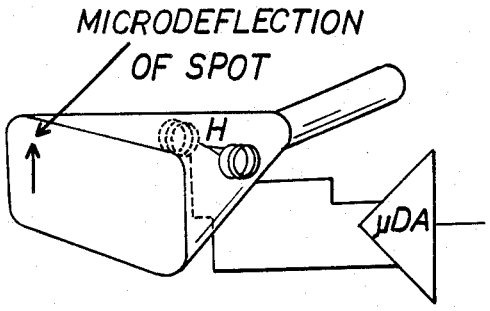
FIG. 2
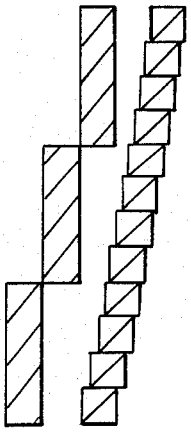
FIG. 3A
FIG. 3B
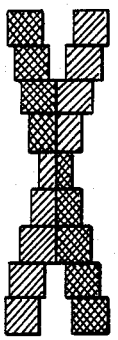
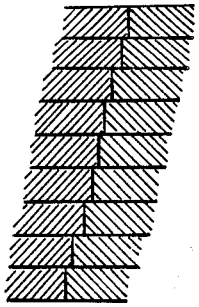
FIG. 3C
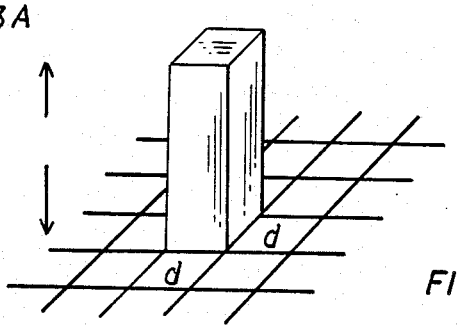
FIG. 1A Kernel Samples (group of pixels)

(A pixel)
V
H
s=0
1
2
3

Low Resolution Input Data
Kernel
High Resolution Output Data

ANTI-ALIASING RASTER SCAN DISPLAY SYSTEM

FIELD OF THE INVENTION

This invention relates to raster-graphics displays, and more particularly to a raster scan-display provided with anti-aliasing means for removing jagged edges from the boundaries of polygons and lines in the image.

DESCRIPTION OF THE PRIOR ART

One disadvantage of moderate-resolution raster-graphics imaging systems is a phenomenon known as aliasing, visible on cathode-ray-tube (CRT) screens as jagged lines called jaggies. It is particularly apparent on lines and curves angled close to the horizontal and vertical axes. In personal computers, for example, users often see jagged circles when they attempt graphics on their low-to-moderate-resolution screens. Even the highest resolution raster graphics (2000×2000) exhibit steps along boundaries at inclinations close to the horizontal and vertical axes.

In "Pixel Phasing Smoothes Out Jagged Lines" by David Oakley, Michael E. Jones, Don Parsons, and Greg Burke, published in *Electronics,* June 28, 1984, there is disclosed an improved system for eliminating jagged lines in a raster display of line segments. That anti-aliasing technique is known as "Pixel Phasing". A pixel can be visualized as a block with height A (amplitude) and base dxd, as shown in FIG. 1A. In accordance with the disclosure hereabove mentioned, four extra bit-planes are included in the frame buffer memory to store micropositioning information in order to displace pixel positions by $\frac{1}{4}$ pixel increments on the CRT screen. Thus, four times as many addressable points are provided on a standard monitor. Then, the effects of moving the base horizontally or vertically in d/4 increments is to change the large steps into many smaller less visible ones.

As illustrated in FIG. 1B, which is a graphic illustration of the Pixel-Phasing anti-aliasing technique applied to a line inclined within +/−45 degrees of the horizontal axis, pixels are displaced $-\frac{1}{4}$, 0, $+\frac{1}{4}$ and $+\frac{1}{2}$ from a bias position of $+\frac{1}{4}$, wherein unity is the distance between two pixels. These increments are referred to by integer, namely the integers 0, 1, 2 and 3 respectively corresponding to 0, $+\frac{1}{4}$, $+\frac{1}{2}$ and $+\frac{3}{4}$ displacements. Such a process is implemented by applying a small horizontal magnetic field, so called the diddle field, between the coils at the side of the cathode-ray tube thereby deflecting the CRT beam up- or downwards from a bias position by small amounts corresponding to the fractional displacements of the pixels, as illustrated in FIG. 2.

An analogous technique is used for lines inclined within +/−45 degrees of the vertical axis. These lines are corrected by displacing the left and right boundaries between pixels. For this purpose, bias is set at $+\frac{1}{2}$, and the displacements of the pixel boundaries are $-\frac{1}{2}$, $-\frac{1}{4}$, 0, $+\frac{1}{4}$. FIG. 3A illustrates how jagged edges are removed from a line close to the vertical axis using the technique described hereabove. FIGS. 3B and 3C illustrate how the anti-aliasing technique can be applied to intersecting lines (FIG. 3B) and boundaries between two solid areas (FIG. 3C).

A block diagram of the implementation of the aforecited scheme is shown in FIG. 4. Eight additional planes (four per buffer) are added to the frame-buffer memory (FBM) 2 to store the 4-bit fractional address associated with each pixel. This fractional address contains 2 bits of horizontal and 2 bits of vertical displacement data. When the digital vector generator 1 (DVG) generates the X and Y addresses for the FBM 2, an extra 2 bits of fractional position data are also generated and stored at the same address location as the visual attribute data. Horizontal displacement is implemented with a 4-phase clock 3. When all the data from the X and Y display lists have been loaded into the frame-buffer memory's read/write buffer, they are copied into the read-only buffer. Both these buffers are part of the FBM. Horizontal and vertical counters 4 then scan the read buffer in a raster format. Visual attribute data are entered into the color-lookup table 5, and the selected colors and intensities are transferred to the digital-analog converters 6. Vertical subpixel address data are loaded into a diddle digital-to-analog converter 7 that is synchronously clocked with the red-green-blue video outputs.

FIG. 5 illustrates the functions of the frame buffer memory 2 and color look-up table 5 shown in FIG. 4. In a conventional frame buffer, the data for a pixel located on the image at position (x,y) is stored at a corresponding integer address (x′,y′). In the Pixel-Phasing technique, in addition to visual attribute data representing intensity, color and blink stored in the P-planes, 2 additional bits per axis of fractional address data (u, v), (i.e., 4 subpixel address bits) are stored at each location. Thus, the location of a pixel can be more accurately specified as:

$$(X, Y)=(x'+u, y'+v),$$

in which the (X,Y) address specifies the location of the pixel. Fractional address data (u,v) together with the pixel address can be calculated by a special digital vector generator (DVG). The (u,v) fractional address can be used to control the spatial distribution of the intensities and therefore the fractional position, removing thereby the stair-step effects inherent in the raster display of polygons.

Although the Pixel-Phasing technique adequately performs the removal of jagged lines in wire-frame images and certain filled polygons, it does not solve the problem of some jagged lines and boundaries of filled polygons inclined at angles less than +/−45 degrees to the horizontal axis. Such an inadequate performance is clearly shown in reverse video wire frame images.

FIG. 6 illustrates an example of a filled disk, obtained by means of the Pixel-Phasing technique, which clearly shows jagged lines at the edges of the top and bottom quadrants. When polygons are rendered by a graphics processor, they are indeed built up from a series of horizontal lines originating and terminating at the boundaries. Each polygon is then filled with an intensity and may comprise other pictorial attributes such as color, shading, . . . During the fill operation, X fractional address can be adequately implemented, resulting in smooth lines with an inclination close to the vertical. But Y fractional addresses implements are poorly processed by the Pixel-Phasing technique, leading to jagged lines.

The inability to properly represent horizontal or quasi-horizontal lines is extended to the raster display of solids, currently rendered as clusters of polygons.

The vertical correction technique previously described has indeed numerous shortcomings. As noted hereabove, the Pixel-Phasing technique diddles successive picture elements up or down by ¼ pixel increments. Translation of a dark or lightly colored pixel over a colored area does not remove the jagged lines as the resulting boundary lines does not stand out in contrast and resembles the original aliased boundary line.

Other anti-aliasing techniques are also known; one software technique, called spatial filtering, is currently available on the market. It consists of filling the intensities of adjacent pixels, which has the major disadvantage of blurring the image. However such software techniques degrade resolution of the image and are slow.

In summation, previous anti-aliasing techniques have proven either to be too slow (processing of the image in a few seconds) or imperfect, such as the Pixel-Phasing technique which rapidly processes an image but suffers from imperfections along polygon boundaries. It should also be noted that most anti-aliasing techniques heretofore known have been implemented in either software or hardware prior to scan conversion for storage in frame buffer memory.

SUMMARY OF THE INVENTION

It is therefore, a principle object of the present invention to overcome the disadvantages in the prior art approaches, and particularly the Pixel-Phasing technique, and to provide an improved apparatus for rapidly eliminating the jagged edges in the raster display of lines and filled polygons.

It is also another object of the invention to provide a higher resolution video image from a lower resolution frame buffer and conversely.

More specifically, it is an object of the present invention to provide a 1200 line video image from a 600 line frame buffer memory.

It is still another object of the present invention to provide an anti-aliasing device for smoothing out jagged lines on polygon boundaries inclined at angles less than +/−45 degrees of the horizontal axis.

The above and present objects of the present invention are accomplished by providing a display system for eliminating jagged lines in a raster display of information having line segments, in particular in a display of polygon boundaries at inclinations within +/−45 degrees to horizontal. In accordance with the invention, the raster display comprises a raster scanned display for displaying the line segments in the form of a plurality of pixels and a display generator for generating video signals. The display generator comprises a digital vector generator, a frame buffer memory, a color lookup table and digital-to-analog converters.

The present invention uses a digital signal processing technique, known as flash convolution to synthesize a 768×1155 pixel image from 768×576 pixels in the frame buffer memory. Two extra bits of precision are generated by the digital vector generator and four extra planes are added to the frame buffer memory to store those extra two bits of precision in each axis at each point location.

Intensity data for each of the colors assigned thereto by the color lookup table (red, green, blue), are convolved with a kernel that is selected by the Y-fractional address. The Y fractional address convolvers are therefore placed in the video output stage of the display system. The kernel of the convolver is controlled by a state sequencer. Another convolver processes the X fractional address with the same kernel and corrects the jagged edges of vectors or polygon boundaries inclined within +/−45 degrees to horizontal. The boundaries between pixels which are controlled by the X fractional address are indeed selected as function of the state of that convolver and the adjacent fractional address.

In summary, the present invention achieves two main improvements over the prior art. First, it generates high resolution video image from a low resolution frame buffer and conversely. More specifically, the dimensions of the synthesized image are 768×1158 instead of 768×576. Second, it eliminates jagged edges of images constructed from polygons. All boundaries in the display system of the present invention are indeed positioned within one quarter pixel accuracy, transforming a 768×576 pixel grid into a 3072×2304 grid. The flash-filtering algorithm implemented in the present invention operates at very high speed. With a spatial filter installed between the frame-buffer memory and the digital-to-analog converters of a graphics engine, the algorithm runs in excess of 30 Megasamples/sec on 24 bit words, so that frames of pixels can be processed at a 60 Hz rate. Images can be rapidly displayed with smooth rather than jagged boundaries.

BRIEF DESCRIPTION OF THE DRAWINGS

The above and other objects, features and advantages of the invention will be more apparent from the following more particular description of the preferred description of a preferred embodiment of the invention, as illustrated in the accompanying drawings in which:

FIG. 1A is a prior art drawing illustrating a pixel;

FIG. 1B is a prior art drawing illustrating the elimination of jagged edges from a line with inclination close to horizontal;

FIG. 2 illustrates an implementation of a prior art raster scanned display system;

FIGS. 3A, 3B and 3C are prior art drawings illustrating the elimination of jagged edges from lines with inclination close to vertical, more specifically from single lines, intersecting lines and boundaries respectively;

DESCRIPTION OF THE PREFERRED EMBODIMENT OF THE INVENTION

Figure 4:
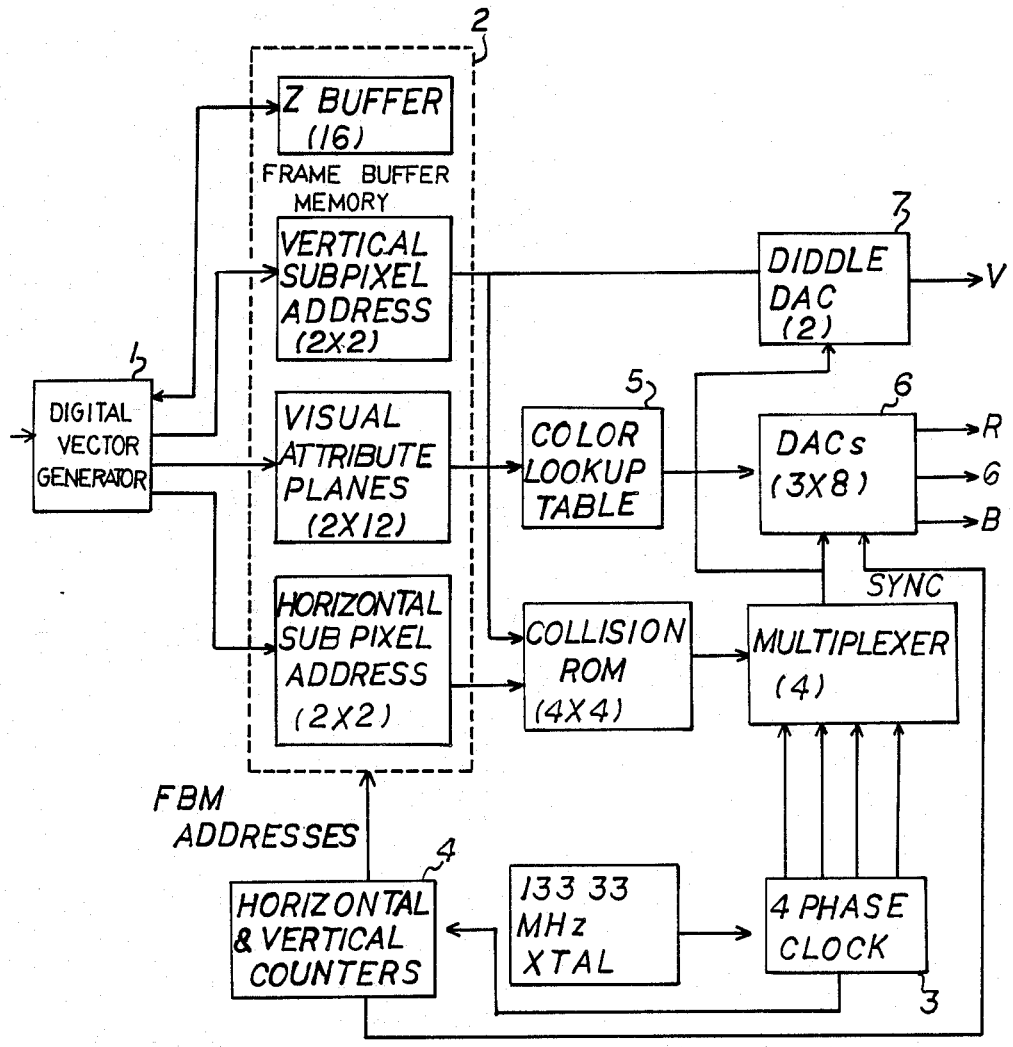
FIG. 4 is a block diagram illustrating a typical global architecture of a raster scan display system according to the prior art.
Figure 5:
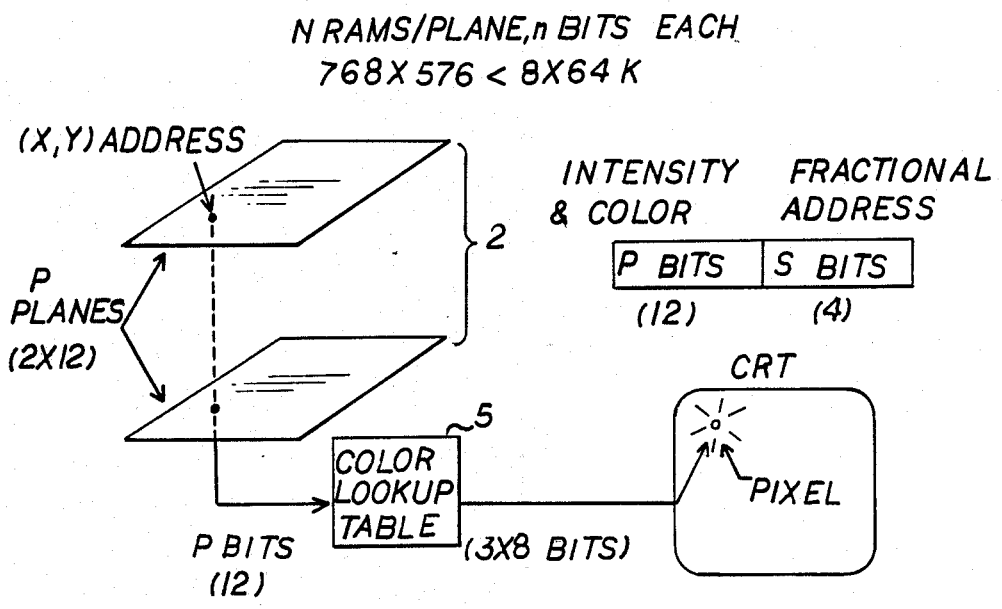
FIG. 5 is a prior art drawing illustrating the typical architecture of a frame buffer memory.
Figure 6:
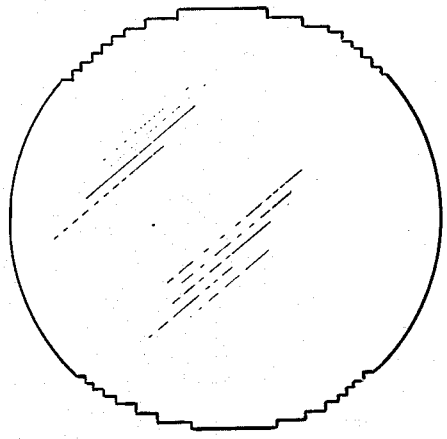
FIG. 6 is a graphic illustration of a filled disk showing jagged edges as obtained by raster scan display system of the prior art.
Figure 7:
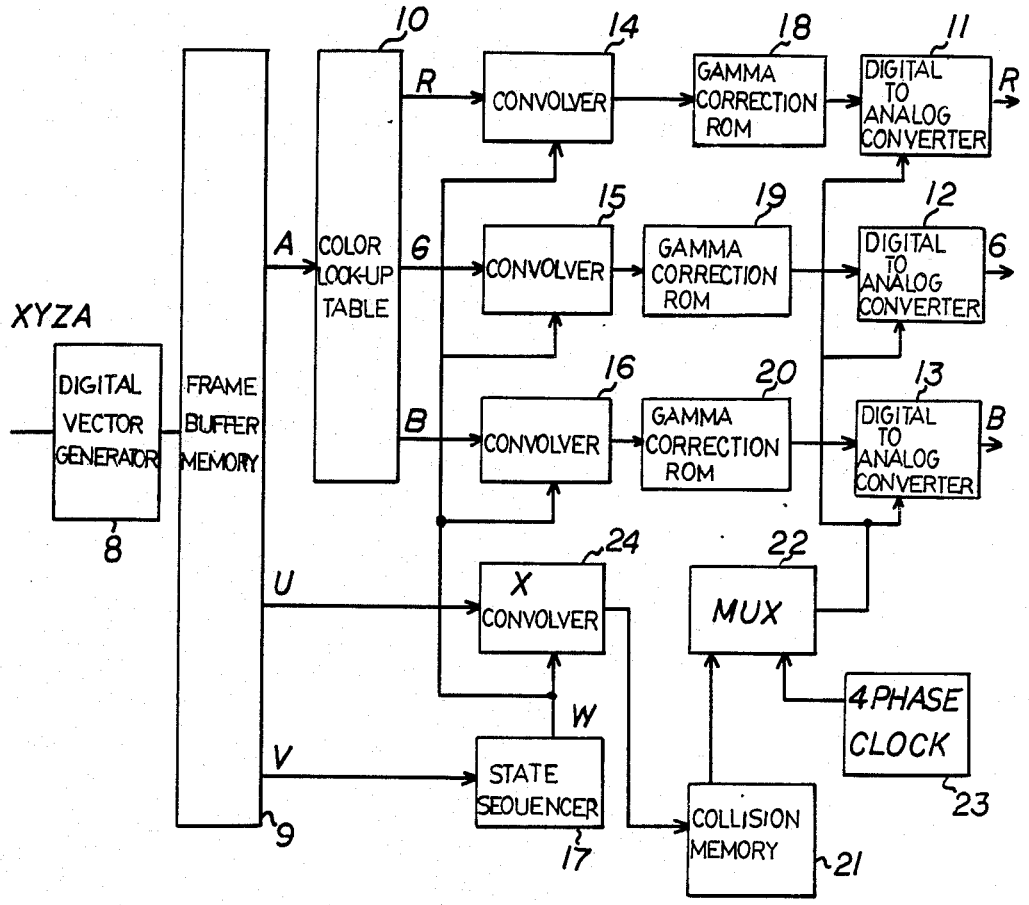
FIG. 7 illustrates in block form a typical global architecture of a raster scan display system in accordance with the present invention.

Referring now to FIG. 7, there is shown the preferred embodiment of the display system of the present invention for displaying line segments. Included is a digital vector generator 8, a frame buffer memory 9, a color lookup table 10 and digital analog converters 11, 12, 13, all of the type previously described in the Pixel-Phasing device of the prior art. Three convolvers 14, 15, 16, respectively connected to the red-green-blue outputs of the color lookup table 10 are inserted at the input of each digital analog converter (DAC). All of the convolvers 14, 15, 16 are set to the same shift state by a state sequencer 17 that is controlled by the fractional addresses of the vertically contiguous pixels on the current and previous two lines. In order to maintain the correct weighting, as will be described more fully hereinafter, three gamma correction ROM's 18, 19, 20 are inserted at the output of the three convolvers 14, 15, 16, and at the input of the three DAC'S 11, 12, 13.

The display device further includes a collision memory 21, which compares pairs of contiguous subpixel addresses, as the raster is horizontally scanned and sends the boundary displacement. The boundary signal from the collision ROM controls a multiplexer 22 that selects one phase of a four-phase clock 23.

A fourth convolver 24 filters the X fractional addresses to control the boundaries between pixels on a scan line and correct jagged lines on vectors or polygon boundaries inclined within +/−45 degrees of the horizontal.

The underlying principle on which the anti-aliasing technique of the present invention is biased, consists of processing an algorithm known as flash convolution in order to synthesize a high resolution (namely 768×1155 pixels) from a low resolution frame buffer (namely 768×576 pixels) in the frame buffer memory 9. In order to better understand the operation of the display system of the present invention, it would appear to be useful to examine the processing of pixels and lines by the flash convolution technique.

Figure 8:
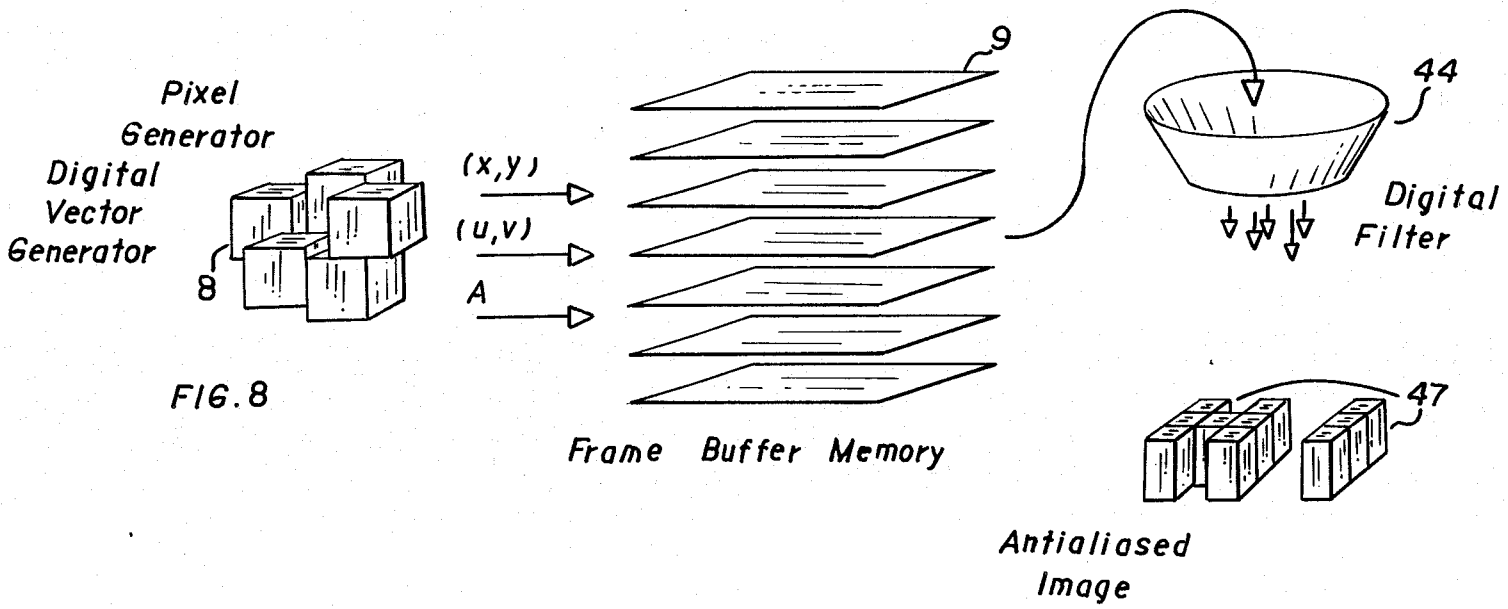
FIG. 8 is a drawing illustrating the fractional addressing and filtering concept implemented in the preferred embodiment of the present invention.
Figure 10:
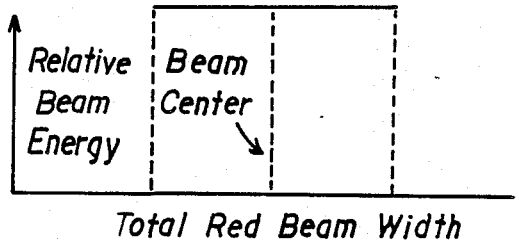
FIG. 10 represents an idealized CRT spot profile commonly used in prior art display systems.
Figure 9:
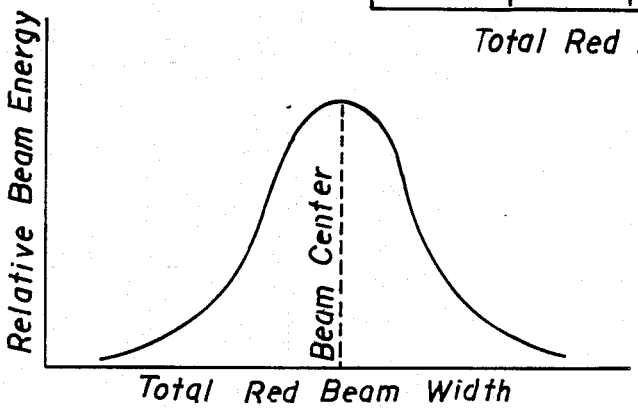
FIG. 9 illustrates the prior art approximation of a CRT spot profile by a Gaussian-like function.

The conceptual implementation of the algorithm is illustrated in FIG. 8. A CRT spot intensity can typically be enveloped by a Gaussian-like profile as illustrated in FIG. 9. FIG. 9 illustrates the prior art approximation of a CRT spot profile by a Gaussian-like function. In FIG. 9, there is schematically illustrated how the intensity of a pixel can be approximated by a Gaussian profile having a predetermined beam width. The intensity of a pixel in the frame-buffer memory (FBM) is indeed rendered as a series of pulses, which are the light output of phosphor dot triads, typically spaced 0.31 millimeters apart. In the previous anti-aliasing techniques, a single pixel is reproduced as a rectangular intensity function as shown in FIG. 10. In this approximation, the beam width is equal to the base of the rectangle which is used to approximate the intensity of the pixel. The basic concept of this invention is to mimic a moderate resolution CRT spot intensity profile on a higher resolution display, thereby allowing a high resolution image to be reproduced from a low resolution frame buffer on a high resolution line monitor.

In the hardware implementation of the present invention, as sketched in FIG. 8, the low resolution pixels generated by the pixel generator 8 (Digital Vector Generator) are written into the frame-buffer 9, and transformed into high resolution pixels by a digital filter 44, yielding an antialiased image 47 on the raster display. In the process, a low resolution pixel may generate several high resolution pixels (usually 3 or 4). For instance, in one preferred embodiment of the present invention, a terminal with 768 horizontal pixels and 576 vertical pixels is modified to incorporate the convolution algorithm hereinbelow described. Since there are four possible locations per pixel on each axis, the addressability is 3072×2304. The number of vertical pixels is 2×576 plus three additional pixels that may be generated by a kernel corresponding to a pixel that is fully displaced downwards, as more completely described hereinafter.

The convolution algorithm of the preferred embodiment of the present invention is implemented differently according to the direction along which the micropositioning of the pixels is performed.

Figure 14:
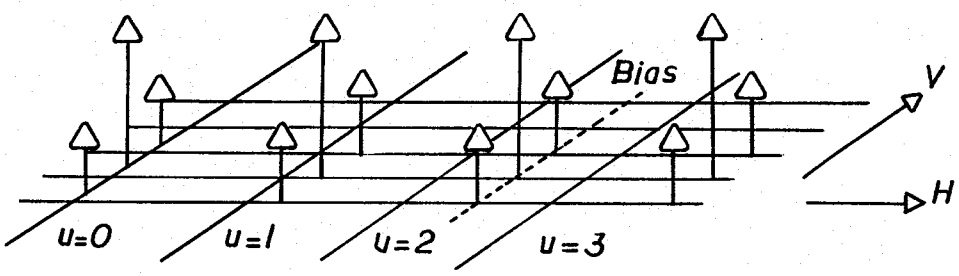
FIG. 14 illustrates the horizontal displacement of the kernel v=0 from bias position in the display system of the present invention.
Figure 15:
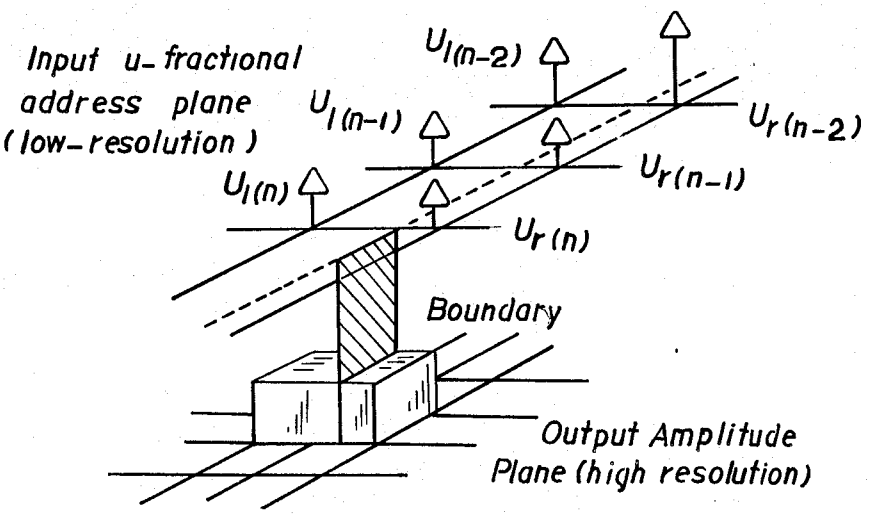
FIG. 15 shows how the boundary between two pixels from the left and right X fractional addresses is generated in the display system of the present invention.

FIGS. 11A, 11B, 11C, 12 and 13 illustrate the concepts used in the vertical micropositioning of the pixels for vectors or polygon edges inclined within +/−45 degrees of the horizontal axis. FIGS. 14 and 15 refer to the horizontal micropositioning principles implemented in the present invention to smooth edges inclined within +/−45 degrees of the vertical axis.

Figures 11A, 11B, 11C, 12, 13:
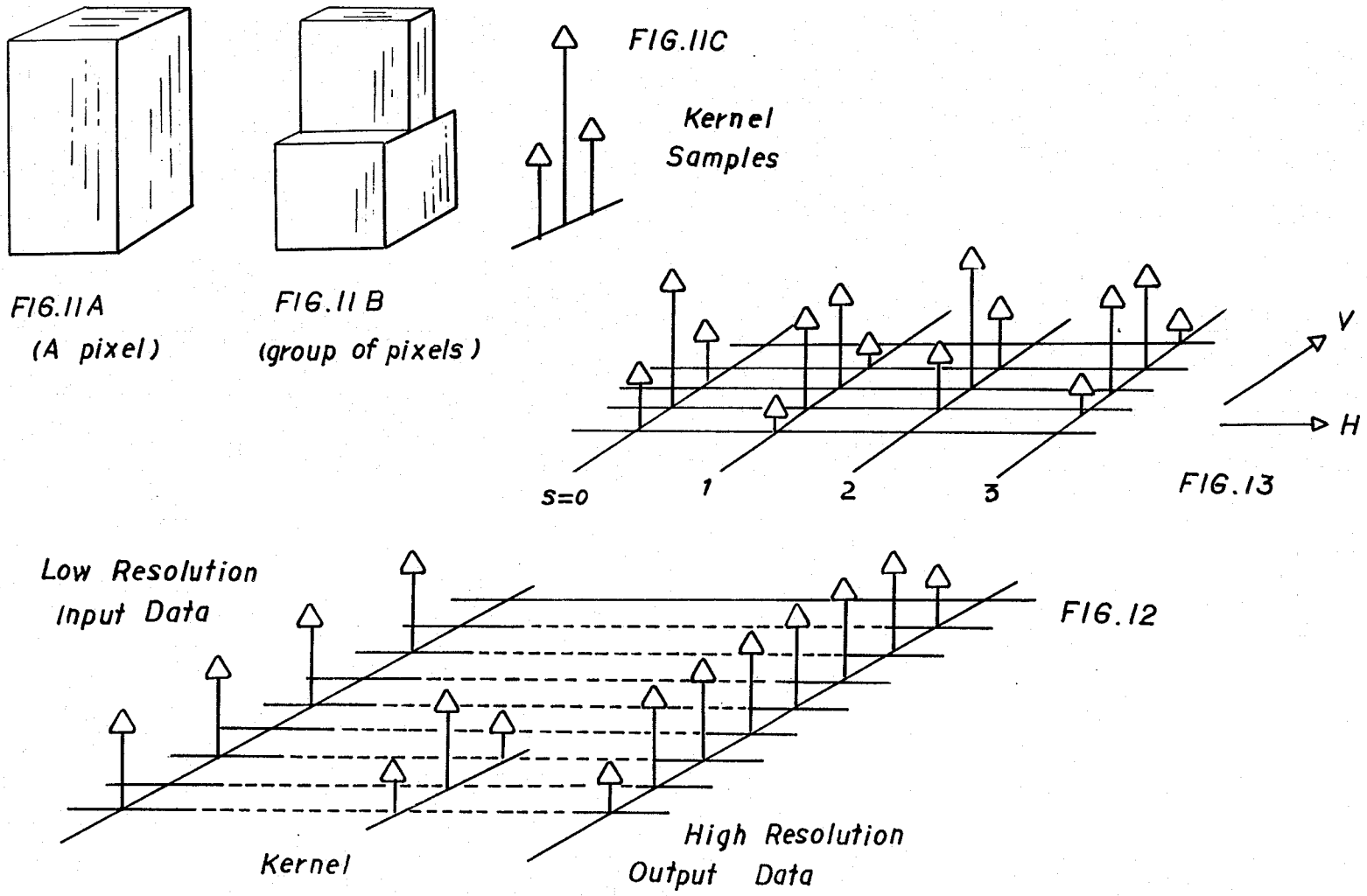
FIGS. 11A, 11B and 11C are drawings illustrating the mapping of a single pixel from low resolution (FIG. 11A), to high resolution (FIG. 11B), and subsequently to samples (FIG. 11C), as performed by the display system of the present invention.
FIG. 12 depicts the mapping of a uniform set of samples to twice the resolution by convolution with a ½, 1, ½ kernel, as performed by the display system of the present invention.
FIG. 13 shows how the distribution of weights is altered within a kernel in order to vertically displace the centroid of the pixel, in the display system of the present invention.

Jagged edges on vectors or polygon edges inclined within +/−45 degrees of the horizontal axis can be smoothed by apparent vertical displacements of low resolution pixels. A low resolution pixel, as illustrated in FIG. 11A, is approximated according to the display system of the present invention by a step-like function of three or four pixels in high resolution space, as shown in FIG. 11B. The distribution is changed to move the center of the pixels. A vertical cut through the lines on a raster display reveals a certain number of lines (typically between 500 and 700 in a low-to-moderate resolution raster graphics imaging system) corresponding to the same amount of samples along the cut. The intensity of a group of pixels is thus rendered as an ensemble of three symmetrical samples of a CRT spot, hereinafter called "kernel". The kernel represented in FIG. 11C corresponding to the group of pixels of FIG. 11B has for instance the following amplitudes: 0.5, 1, 0.5. When low resolution data are convolved with the kernel depicted in FIG. 11C in high resolution space, the set of samples is mapped from a lower resolution to a higher resolution, typically from one resolution to twice the resolution with the particular kernel depicted in FIG. 11C.

FIG. 12 illustrates how four low resolution input data are mapped into eight resolution output data using the $\frac{1}{2}$, 1, $\frac{1}{2}$ kernel of FIG. 11C.

Each point in the frame-buffer memory is thus transformed to image space by convolution with a kernel, also called "weighting function". This allows to change the density of the raster lines, typically to double it from 576 lines to 1155 per picture height. The convolution algorithm is processed in the image space rather than in the buffer, which only has 576 lines versus 1155 raster lines in the image space, in the preferred embodiment of the present invention.

Mathematically, the equation for the convolution function is defined as the following discrete sum:

$$A(n) = \sum_{k=0}^{2} a(n-k) \cdot W(k) \tag{1}$$

wherein

A(n) is the output amplitude of the $n^{th}$ pixel sample, a(n−k) is the input sample of the $n-k^{th}$ point in the pixel image space and W(k) is the $k^{th}$ element of the kernel (also the $k^{th}$ weight in the weighting function).

If a point is to be displaced, then the fractional address contains at least 2 extra bits of precision. Thus the point location is more accurately specified by the sum of the integer address (x',y') and the fractional address (u,v). The kernel W(k) (k varying between 0 and 2) can be modified to include the impact of the fractional address.

Referring now to FIG. 13, there are shown the kernels corresponding to different fractional addresses. It can be seen that the envelope of the kernels is always an inverted V shape but the location is displaced in quarter pixel dimension increments. Numerically, the values of the four kernels corresponding to a state s, are given in Table 1.

TABLE 1

| s | w (expressed in quarters) |
|---|---|
| 0 | 24200 |
| 1 | 13310 |
| 2 | 02420 |
| 3 | 01331 |

Thus, these additional kernels correspond to relocation of the low resolution pixel in increments of $\frac{1}{4}$ pixel dimension.

Equation (1) can now be rewritten as:

$$A(n) = \sum_{k=0}^{4} a(n-k) \cdot W(s, k), \tag{2}$$

wherein

W(s,k) is the kth element of a 5-element kernel variable with component weights that are a function of s.

State s is a function of the current and previous fractional address v(n), v(n−1) as shown in Table 2:

TABLE 2

| v(n) | v(n − 1) | s(n − 1) | s(n) |
|---|---|---|---|
| 2 | 2 | x | 2 |
| g | 2 | x | g |
| 2 | g | x | g |
| g | h | x | INT [(g + h + 1)/2] |
| 2 | 2 | 3 | 4 |

wherein x is unspecified, g and h have the value 0, 1 or 3, and INT is the integer operator.

It should be noted that the fractional address (u,v) has been biased to (1,2). The u-bias will be examined in detail subsequently. The points are therefore written over a background with v=2. In other words, undeflected pixels are biased to v=2. This bias limits the maximum displacement of a pixel to d/2. Also, to simplify processing, s is expressed as an integer rather than a fraction ($\frac{1}{4}$=1, $\frac{1}{2}$=2, $\frac{3}{4}$=3, etc . . . ). In the first three cases, a fractional address different than 2 will overwrite a 2-value. When both the present and previous fractional address values are different than 2, the machine state is the average of the two. The anomalous fifth stage propagates the final $\frac{1}{4}$ weighting of the s=3 state. The previous s state is stored to detect this situation. There may be other anomalous states besides s=4.

Although there are only four fractional addresses, there are five kernels. The fifth is included to process the case of s=3 (w=01331, . . . , w's in quarters) followed by two s=0 fractional addresses. Without an s=4 state, the pipe would be flushed and the w=1 weighting would be lost. Instead, the case is detected and an s=4 state set.

Reference is now made of FIGS. 14 and 15 which illustrate how edges inclined within +/−45 degrees of the vertical axis, can be smoothed by horizontal displacement of pixel boundaries. In order to benefit from the advantages of the known Pixel-Phasing technique scheme, it has proven to be necessary to further apply the convolution process to x-fractional address data U. The display system of the present invention, thus, retains the advantages pertaining to the Pixel-Phasing technique.

As illustrated in FIG. 14, the kernel biased to (u,v)=(1,2) is displaced horizontally from its bias position. The location of the boundary between two pixels is set as a function of the fractional addresses u(n), u(n−1), u(n−2) of the current, penultimate and antepenultimate pixels as illustrated in FIG. 15. $u_l$ and $u_r$ are the horizontal fractional addresses of the left and right pixels above the boundary.

Boundary locations are determined by means of the following algorithm. First, the horizontal fractional address data, u is treated like amplitude data. The convolution transform of the horizontal fractional address is therefore given by equation (3):

$$U(n) = \sum_{k=0}^{4} u(n-k) \cdot w(s, k) \tag{3}$$

wherein u(n) is the fractional address of the $n^{th}$ low resolution pixel in high resolution space, w(s,k) is the kernel element of equation (2) expressed as a fraction, U(n) is the output subpixel address.

Once the left and right horizontal fractional addresses, $U_l(n)$ and $U_r(n)$ of a pair of pixels have been calculated, the boundary, $U_b$ between $U_l$ and $U_r$, can be simply determined by indexing a lookup table (the collision ROM 21) containing the data in Table 3.

TABLE 3

| $U_l$ | $U_r$ | $U_b$ |
|---|---|---|
| l | l | l |
| l | g | g |
| g | l | g |
| g | h | INT [(g + h + 1)/2] |

In this table, g and h have the values 0, 2 or 3, INT is the integer operator, and a bias, u=1 is applied. Again, this bias minimizes the displacement. For most situations, however, pixel widths are greater than d/2.

Table 4 illustrates how the X correction data can be propagated across several lines.

TABLE 4

| (a,u,v) | Kernel w | u data | a data | U | Output A |
|---|---|---|---|---|---|
| b,1,2 | 02420 | 10101 | b0000 | $\frac{1}{4}$ | b |
| | 02420 | 01010 | 0b000 | $\frac{1}{4}$ | b |
| c,2,2 | 02420 | 20101 | c0b0b | $\frac{1}{4}$ | b |
| | 02420 | 02010 | 0c0b0 | $\frac{3}{8}$ | b/2 + c/2 |
| b,1,2 | 02420 | 10201 | b0c0b | $\frac{1}{2}$ | c |
| | 02420 | 01020 | 0b0c0 | $\frac{3}{8}$ | b/2 + c/2 |
| b,1,2 | 02420 | 01010 | 0b0b0 | $\frac{1}{4}$ | b |
| | 02420 | 01010 | 0b0b0 | $\frac{1}{4}$ | b |

In this particular example, the data may represent a cross-section across a horizontal line with intensity c on a background with intensity b. Note the bias of the fractional addresses set to (1,2), but the horizontal line fractional address is (2,2).

In Table 4, (a,u,v) is the intensity and fractional address of the point, w is the kernel of the convolver. The a-data are intensities of the point, whereas the u data are the fractional addresses of the point. U is the total output fractional address and A is the total output intensity address.

U and A can be simply calculated by taking the scalar products of the w vector with respectively the u vector and the a vector.

Note that in Table 4, the c point data is delayed by two resolution pixels in the Y direction, and that the X-fractional address output U tracks the intensity data A. All of the integers shown in column 2 are in quarters.

The convolution technique described hereabove for points and lines can be extended to polygons, which are built up from a series of horizontal lines and further for solids which are rendered as clusters of polygons. In this case, the polygon fill pattern (intensity, visual attributes) and the polygon boundary are drawn separately. In a first stage, the fill pattern is performed without resorting to any anti-aliasing technique. Consequently, all the pixels have a vertical bias, equal to 2. In a second stage, the polygon boundary is written into the frame-buffer. When the points are read out of the frame-buffers, the state of the convolver is set by both the polygon interior and the boundary pixels.

Table 5 illustrates how vertical pixel data progress through the filter for a typical polygon boundary. Polygon intensity is p and the background intensity is 0.

TABLE 5

| Input (a,u,v) | data a | kernel w (in quarters) | output A |
|---|---|---|---|
| . | . | . | . |
| . | . | . | . |
| . | . | . | . |

TABLE 5-continued

| Input (a,u,v) | data a | kernel w (in quarters) | output A |
|---|---|---|---|
| p,x,2 | p0p0p | 02420 | p |
| — | 0p0p0 | 02420 | p |
| p,x,2 | p0p0p | 02420 | p |
| — | 0p0p0 | 02420 | p |
| p,x,1 | p0p0p | 13310 | p |
| — | 0p0p0 | 13310 | p |
| 0,x,2 | 00p0p | 13310 | $\frac{3}{4}$p |
| — | 000p0 | 13310 | $\frac{1}{4}$p |
| 0,x,2 | 0000p | 02420 | 0 |

Until the row *, the output A, after being convoluted with the kernels 02420, yields the value:

$$\text{for } p0p0p\text{: } A = \tfrac{1}{4}(0.p + 2.0 + 4.p + 0.2 + p.0) = p$$
$$\text{for } 0p0p0\text{: } A = \tfrac{1}{4}(0.0 + 2.p + 4.0 + 2.p + 0.0) = p$$

At row *, a boundary pixel sets the convolver state to 1, which changes the kernel to (13310). The new value of the output A is hence:

$$\text{for } p0p0p\text{: } A = \tfrac{1}{4}(1.p + 3.0 + 3.p + 1.0 + 0.p) = p$$
$$\text{for } 0p0p0\text{: } A = \tfrac{1}{4}(1.0 + 3.p + 3.0 + 1.p + 0.0) = p$$

The following values of the input data successively yield the following values for the output:

for 00p0p: A=$\frac{3}{4}$p for 000p0: A=$\frac{1}{4}$p for 0000p: A=0 (kernel 02420)

Figure 16:
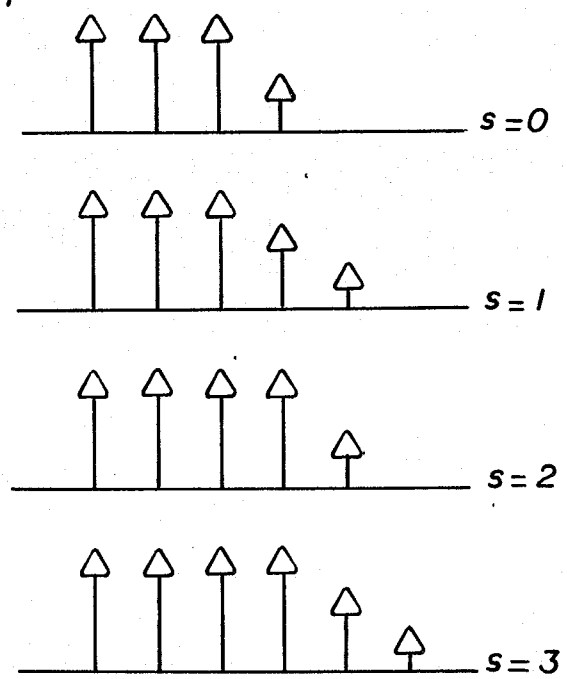
FIG. 16 is a vertical cut through samples of a filled polygon showing correct termination of the boundary, as performed by the display system of the present invention.

The termination sequence representing a boundary of the filled polygon is further illustrated in FIG. 16, which shows for each value of the convolver state, the amplitude of the pixel intensity at the boundary. As shown, the amplitude of the pixel intensity rapidly decreases at the boundary according to the pattern described in Table 5, namely: p, $\frac{3}{4}$p, $\frac{1}{4}$p, 0.

Thus the synthesized image yielded clearly shows a filled polygon without any jagged lines. The desired image is hence anti-aliased and, combined with rapid rendition, constitutes a major improvement over all known anti-aliasing techniques.

Figure 17:
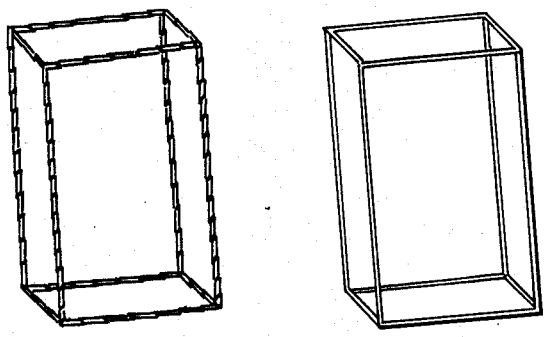
FIG. 17 represents two parrallelepipeds on a light background respectively without and with anti-aliasing as performed by the display system of the present invention.

FIG. 17 depicts the images yielded by the preferred implementation of the present invention along with the original image without anti-aliasing. More specifically, it represents a parallelepiped on a light background. Polygon boundaries are effectively smoothed out and correctly anti-aliased. It should be noted that black lines on a light background are equivalent to polygons on a dark background.

Referring now to FIG. 7 again, the display system comprises both convolvers 14, 15, 16 for filtering the intensity data and gamma correcting means 18, 19, 20 for matching those data to the non-linear transfer characteristic of the CRT.

Figure 18:
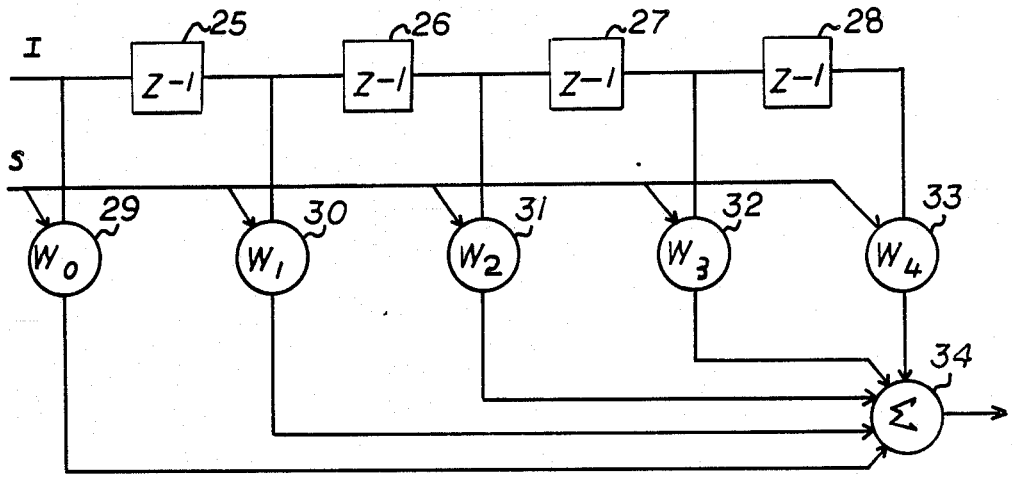
FIG. 18 illustrates in block form the implementation of the mapping of 600 line data into a 1200 line space, in accordance with the present invention.

FIG. 18 shows the hardware mechanisation of a convolver for mapping 600 line data into 1200 line space when the fractional address is also included with the incoming data. In FIG. 18, there are shown four z(−1) operators 25, 26, 27, 28 which each delays the data by one line period. The kernel illustrated on FIG. 18 has weights $w_0$, $w_1$, $w_2$, $w_3$, $w_4$, and varies with the fractional address (s-dependency). To shift the pixel location, data from up to four previous lines must be included, so that it is necessary to incorporate four delay elements 25, 26, 27, 28 and five weights 29, 30, 31, 32 and 33. The intensity data, after being delayed by the delay operators and weighted by the weights $w_0$, $w_1$, $w_2$, $w_3$, $w_4$ are summed by the adder operator 34 to yield the total output intensity.

Data are sampled on even lines only, and the fractional address of the incoming data determines the kernels. This kernel is held for the current and the next line. As mentioned hereabove, a bias of (u,v)=(1,2) has been applied to the fractional address data by the DVG 8 in order to minimize the displacement of any point from the bias value. The actual tabulation of the generation of the values of s was given in Table 1.

Figure 19:
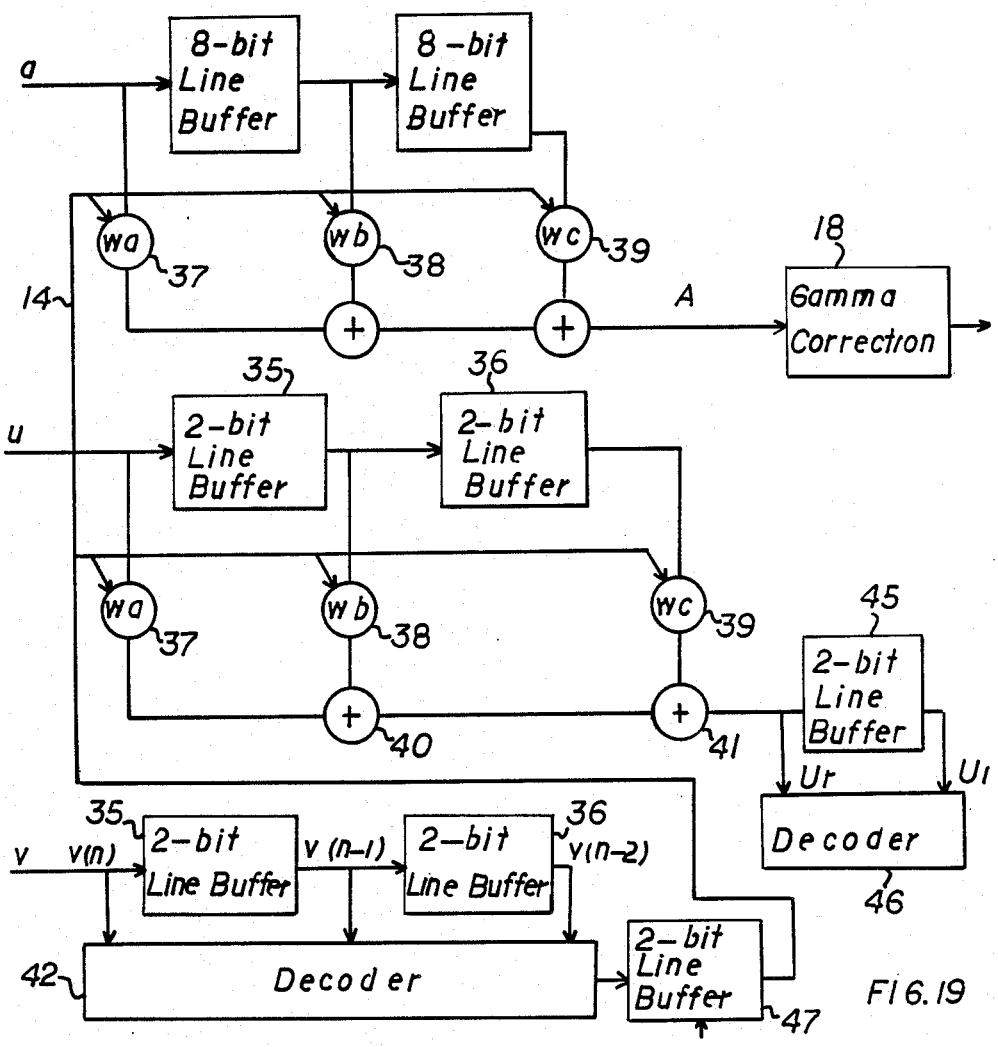
FIG. 19 shows exemplary circuitry of a single channel convolution of the raster display system in accordance with the present invention.

Reference is now made of FIG. 19 which shows the architecture of the amplitude convolvers 14, 15, 16 and the u and v decoders. Only one of the three amplitude convolvers 14 is shown, and its input is "a" rather than the "r", "g" or "b" fundamental colors.

Due to the nature of the incoming data, the implementation of the convolution process can be simpler than the circuit illustrated in FIG. 18. In a 1200 line space, input data are present only on the even lines beginning at the $0^{th}$ line. Data on the odd lines are indeed always zero. Consequently, only two RAM's 35, 36 and three weights 37, 38, 39 corresponding to the even samples are required for each fractional address (u and v).

The y-fractional addresses, v(n) of the current and the penultimate v(n−1) pixels above the current pixel, the raster being scanned downwards, determine the state of the convolver, s. The state, s is then filtered by the odd/even frame count to determine which elements of the kernel are to be selected. Weights $w_0w_2w_4$ are applied on even frames when data is read into the filters. Weights $w_1w_3$ are applied on odd frames when the data input is zero. Thus, $w_aw_bw_c$ is simply $w_0w_2w_4$ on even frames, whereas $w_bw_c$ becomes $w_1w_3$ on odd frames.

Thus, for two contiguous lines of output, the filter data is held constant and only the weights of the kernel are changed. Variable kernel $w_aw_bw_c$ is switched between $w_0w_2w_3$ and $w_1w_3$.

In high resolution space, the even lines of pixels a (all lines in low resolution space) with amplitude, are read into the amplitude convolver. These pixels are then filtered in high resolution space to spread them over three or four vertical samples, and to allow micropositioning of the envelope of the samples by applying different kernels. Output pixels, A are then gamma corrected to make the displayed convolution process linear on the CRT monitor.

Horizontal fractional addresses, u are processed to determine the micropositioning of the boundaries between pixels contiguous in the horizontal direction. The u data is filtered in exactly the same way as the a data. Then the left and right outputs $U_l$ and $U_r$ are separated by a one line delay buffer 45. Finally, $U_l$ and $U_r$ are entered into a lookup Table 46 to calculate the boundary location $U_b$ which selects the clock phase to be applied to the DAC's, thus allowing pixels to be displaced either left or right from their bias position. The boundary value is used to set the clock phase applied to the DAC's that supply video to the CRT monitor. Earlier clocking moves the boundary left and later clocking moves it right.

Still referring now to FIG. 19, the summation of the intensity data is performed in two stages. The output data of the first two weights 37, 38 are summed at 40 and the result is added at 41 to the third output data originating from the third weight 39. As mentioned hereabove, at the adder output 41 of the convolver represented in FIG. 13, a ROM 18 is placed in order to gamma correct the data.

An exsmple of a typical process with s=3 is shown in Table 6 (note that w is in quarters).

TABLE 6

| Output line # | input | v | s | z(−1) | z(−2) | w |
|---|---|---|---|---|---|---|
| n − 2 | a | 2 | 2 | 0 | 0 | 040 |
| n − 1 | — | — | 2 | a | 0 | 022 |
| n | b | 3 | 3 | a | 0 | 030 |
| n + 1 | — | — | 3 | b | a | 013 |
| n + 2 | 0 | 2 | 3 | b | a | 030 |
| n + 3 | — | — | 3 | 0 | b | 013 |
| n + 4 | 0 | 2 | 4 | 0 | b | 040 |

In this example, an input of intensity a, v=2 is applied at sample n−2, and an input of intensity b, u=3 is applied at sample n. At sample n+4, the special kernel is applied to generate the output a and to add any other data from samples n+2 and n+4.

The convolver represented in FIG. 19 further comprises a state decoder 42 and a sequencer 17 not shown. The sequencer 17 is incremented by the pixel clock 23 and reset by the line synchronisation. The kernel is selected by a state decoder 42 that examines V(n), V(n−1) and V(n−2) in order to determine whether either is biased (implying that the background is to be overwritten) or whether the subpixel address should be averaged or in order to detect the s=4 condition, and the decoder output provided to RAM 47.

Referring now again to FIG. 7, the timing proceeds as follows. Typically, a single line out of the frame buffer 9 can be read every 14 microseconds. Thus, 1200 lines can be read in 1/60 seconds. Allowing for retrace of the CRT monitor, about 1150 lines can be displayed. Timing of both the convolvers 14, 15, 16 and the FBM 9 can be simplified by interlacing the image to be displayed on the CRT. Previously, with the Pixel-Phasing technique, a repeat field (non-interlaced) image was displayed.

Relative to the output frames, first all the even lines are displayed, then all the odd lines. But data input occurs only on the even lines, as was indicated previously. The scan video rates presently obtained in the display system of the prior art, using a Pixel-Phasing technique, are therefore maintained with a minor change in the even/odd field timing. The RAM cycle times in the FBM 9 are also unchanged. Furthermore, the delay memory elements in the convolver can be implemented with static RAMS's characterized by a 30 nanosecond read-modify-write cycle. No degradation of image quality due to flicker can be expected since data must always be written on at least two fields.

Referring to FIG. 19 again, data is stored in the static RAM line-buffers 35 and 36 as follows. Rather than storing data in a static RAM and then shifting this data to the next RAM, a more sophisticated approach using pointers is employed. Data is stored once in a selected RAM, and then pointers select the horizontal position of pixel data and the data from the previous and ancient lines. Three groups of RAM's per color are required: one is written with current pixel data, and the others store data from the previous two lines.

With interlacing, the RAM timing is not so critical. If the RAM's storing a line are divided into three groups of 256 elements, each group need be accessed only every 90 nanoseconds.

Some improvements can be incorporated into the convolver algorithms. These include addition of a bias in the subpixel address; replacement of the 01331 weighting function with a 01430 weighting; and addition of boundary planes to the FBM.

Moreover, the Y bias weighting of 02420 distributes the intensity weighting between contiguous pixels more evenly and is therefore preferable.

In summation, the preferred embodiment of the present invention has proven to be a major improvement over the anti-aliasing devices heretofore known. A comparison of the rendering speeds between a 1024 line monitor and the 600 line graphics terminal modified in accordance with the preferred embodiment of the present invention has shown that for large polygons (greater than 1 cm/side on a 19" monitor), a 768×576 pixel image is rendered three times faster than a 1280×1024 image. This result is expected since there are three times less pixels to be written in the device of the present invention. For smaller polygons, the rendering speed is limited by the troughput rate of the graphics pipeline. For example, for a $0.5\times0.5$ $cm^2$ polygon, the transformation of vertices may be slower than filling the interior.

Significant savings in frame-buffer memory cost may accrue. For a frame buffer that is "deep" (double buffered; z-buffered; numerous color planes; overlay and underlay planes), there may be more than fifty planes. Even though four fractional address may be added, a 600 line system contains 35% of the RAM of a 1000 line system.

While the preferred embodiments of the invention have been described and modifications thereto have been suggested, other embodiments may be devised and modifications made thereto without departing from the spirit of the invention and the scope of the appended claims.

What is claimed is:

1. In combination with a raster-scan display system in which the path of a writing beam over an array of a displayed image forming pixels is controlled by means of a analog cartesian deflection signals, a video signal processor for smoothing oblique and circular lines, which comprises:

a digital vector generator for generating digital data corresponding to vector locations defined by a display list, including intensity data and fractional address data respectively comprising a set of additional bits of precision corresponding to a first axis of displacement and a set of additional bits of precision corresponding to a second axis of displacement for each pixel;

a frame buffer memory for storing said digital data, including said intensity data and fractional address data;

means for assigning a plurality of fundamental colors to said intensity data;

means for convolving said intensity data with at least one kernel comprising weights function of a state controlled by the fractional addresses corresponding to said second axis of displacement, designed to transform said intensity data from one resolution in said frame-buffer memory to a different resolution in the displayed image, said means for convolving said intensity data further convolving said fractional address data corresponding to said first axis of displacement with said kernel in said state, said means for convolving said intensity data being also designed to determine boundaries between said pixels as a function of said fractional addresses corresponding to said first axis of displacement, on either side of said boundaries, said means for convolving said intensity data being related to the outputs of said means for assigning fundamental colors, wherein each of said means for convolving said intensity data for each of said axes of displacement further includes:

first means for delaying by one line period said digital data;

means for weighting said digital data delayed by said first means for delaying; and means for summing said digital data after said data have been weighted by said means for weighting; and wherein said means for convolving said intensity data for said first axis of displacement further comprises second means for delaying by one line period digital data corresponding to said first axis of displacement and for separating said data in left output data associated with the left boundary between said pixels and right output data associated with the right boundary between said pixels;

means for gamma correcting the outputs of each of said means for convolving said intensity data, said means for gamma correcting being related to the output of each of said means for convolving said intensity data;

a plurality of digital-to-analog converting means, each of which is placed at the output of each of said means for gamma correcting, for generating said analog deflection signals corresponding to each fundamental color signal in frame of said raster scan display system; and means for synchronizing and timing, said means being connected to the input of said digital-to-analog converting means.

2. The video signal processor of claim 1, wherein said means for convolving said intensity data for said axis of displacement further comprises decoding means for calculating the boundary location between said pixels using said right and left output data.

3. The video signal processor of claim 2, wherein said decoding means comprise a collision ROM.

* * * * *